US009284153B2

(12) United States Patent
Liu et al.

(10) Patent No.: US 9,284,153 B2
(45) Date of Patent: Mar. 15, 2016

(54) BUNDLING APPARATUS FOR SHEET-TYPE MEDIUM

(75) Inventors: Heng Liu, Guangzhou (CN); Dong Tan, Guangzhou (CN); En Wu, Guangzhou (CN); Fa Ran, Guangzhou (CN)

(73) Assignee: GRG BANKING EQUIPMENT CO., LTD., Guangzhou (CN)

( * ) Notice: Subject to any disclaimer, the term of this patent is extended or adjusted under 35 U.S.C. 154(b) by 72 days.

(21) Appl. No.: 13/884,267

(22) PCT Filed: Mar. 27, 2012

(86) PCT No.: PCT/CN2012/073087

§ 371 (c)(1),
(2), (4) Date: May 9, 2013

(87) PCT Pub. No.: WO2012/152144

PCT Pub. Date: Nov. 15, 2012

(65) Prior Publication Data

US 2014/0044515 A1 Feb. 13, 2014

(30) Foreign Application Priority Data

May 6, 2011 (CN) ..... 2011 1 0116610

(51) Int. Cl.
*B65H 31/30* (2006.01)
*B65H 39/00* (2006.01)
(Continued)

(52) U.S. Cl.
CPC ..... *B65H 39/00* (2013.01); *B65B 27/08* (2013.01); *B65H 31/3045* (2013.01);
(Continued)

(58) Field of Classification Search
CPC .. B65H 39/00; B65H 39/105; B65H 31/3045; B65H 31/3063; B65H 33/16; B65H 2301/4213; B65H 2301/43824; B65H 2402/352; B65H 2404/656; B65H 2405/54; B65H 2408/13; B65H 2553/51; B65H 2701/1912; B65B 27/08
USPC ..... 414/788.1, 789.9
See application file for complete search history.

(56) References Cited

U.S. PATENT DOCUMENTS 2,917,884 A * 12/1959 Winkler et al. ..... 53/586
4,483,124 A 11/1984 Ohba et al.
(Continued)

FOREIGN PATENT DOCUMENTS

CN 2818338 Y 9/2006
CN 1881263 A 12/2006
(Continued)

OTHER PUBLICATIONS

The European Search Report issued on Sep. 1, 2014 for European counterpart application 12782983.6, 5 pages.
(Continued)

*Primary Examiner* — Saul Rodriguez
*Assistant Examiner* — Lynn Schwenning
(74) *Attorney, Agent, or Firm* — Kilpatrick Townsend & Stockton LLP

(57) ABSTRACT

A bundling apparatus for sheet-type medium is used for stacking and bundling sheet-type medium. The bundling apparatus for sheet-type medium comprises a banknote delivery channel (11), a bundling mechanism (13) and a position switching mechanism (14), a banknote stacking position (61) formed at the end of the banknote delivery channel as well as a bundling position (62) formed corresponding to the bundling mechanism, the position switching mechanism (14) comprising a rotating power shaft (41) driven by an electric motor and at least two banknote stacking plates (51) installed evenly on the power shaft. When any banknote stacking plate is located in the banknote stacking position, a corresponding banknote stacking plate is located in the bundling position. The present invention achieves the transition between the motion of stacking and bundling the sheet-type medium, improves work efficiency and saves space.

11 Claims, 10 Drawing Sheets

(51) Int. Cl.
*B65H 33/16* (2006.01)
*B65H 39/105* (2006.01)
*B65B 27/08* (2006.01)

(52) U.S. Cl.
CPC ..... *B65H 31/3063* (2013.01); *B65H 33/16* (2013.01); *B65H 39/105* (2013.01); *B65H 2301/4213* (2013.01); *B65H 2301/43824* (2013.01); *B65H 2402/352* (2013.01); *B65H 2404/656* (2013.01); *B65H 2404/692* (2013.01); *B65H 2405/54* (2013.01); *B65H 2408/13* (2013.01); *B65H 2553/51* (2013.01); *B65H 2701/1912* (2013.01)

(56) References Cited

U.S. PATENT DOCUMENTS

| | | | | |
|---|---|---|---|---|
| 4,511,301 | A | 4/1985 | Kawano et al. | |
| 4,531,344 | A * | 7/1985 | Sato et al. | 53/447 |
| 4,564,185 | A | 1/1986 | Hamlin et al. | |
| 4,582,421 | A | 4/1986 | Hamlin et al. | |
| 4,588,070 | A * | 5/1986 | Smith | 198/468.3 |
| 4,678,179 | A | 7/1987 | Edwards et al. | |
| 4,925,173 | A * | 5/1990 | Lindblom et al. | 270/52.14 |
| 5,127,209 | A * | 7/1992 | Hunter | 53/439 |
| 5,503,518 | A | 4/1996 | Scholz | |
| 2007/0001384 | A1 * | 1/2007 | Yoshioka | 271/177 |

FOREIGN PATENT DOCUMENTS

| | | | |
|---|---|---|---|
| CN | 101177214 | A | 5/2008 |
| CN | 101342953 | A | 1/2009 |
| CN | 101423125 | A | 5/2009 |
| CN | 101551923 | A | 10/2009 |
| CN | 201322955 | Y | 10/2009 |
| CN | 101763686 | A | 6/2010 |
| CN | 101960494 | A | 1/2011 |
| CN | 102275765 | A | 12/2011 |
| DE | 19943486 | A1 | 3/2001 |
| EP | 1555206 | A1 | 7/2005 |
| JP | 60-167839 | A | 8/1985 |
| JP | 64-9120 | A | 1/1989 |
| JP | 4272062 | A | 9/1992 |
| WO | 2008030819 | A1 | 3/2008 |

OTHER PUBLICATIONS

The Examination Report No. 1 issued on Oct. 29, 2014 for the Australian counterpart application 2012253047, 3 pages.

* cited by examiner

BUNDLING APPARATUS FOR SHEET-TYPE MEDIUM

The present application is the national phase of International Application No. PCT/CN2012/073087, titled "BUNDLING APPARATUS FOR SHEET-TYPE MEDIUM", filed on Mar. 27, 2012, which claims the benefit of priority to Chinese Patent Application No. 201110116610.4, entitled "SHEET-TYPE MEDIUM BUNDLING DEVICE", filed with the 5 Chinese State Intellectual Property Office on May 6, 2011, the entire disclosure of which is incorporated herein by reference.

FIELD OF THE INVENTION

The present application relates to a sheet-type medium bundling device, in particular, to a sheet-type medium bundling device which can achieve a cooperation of the stacking and the bundling operations of sheet-type mediums by position switching.

BACKGROUND OF THE INVENTION

As sheet-type mediums, such as paper money, paper, bill or the like, are commonly used in our everyday life, various mechanical apparatus for sheet-type mediums are becoming available, such as a separating apparatus, a detecting apparatus, a bundling apparatus or the like. In the sheet-type medium bundling device, the sheet-type mediums need to suffer four successive processes, i.e., a stacking operation, an arranging operation, a bundling operation and a conveying operation. Therefore, the traditional sheet-type medium bundling device includes a conveying passage, an arranging mechanism, a clamping and conveying mechanism and a bundling mechanism. The clamping and conveying mechanism normally employ a mechanical pushing member. In operation, every single sheet of sheet-type medium is conveyed to a stacking plate at the arranging mechanism via the conveying passage. After a time period of T1, a stack of sheet-type mediums is formed. The arranging mechanism performs a long side arranging and a short side arranging to the stack of sheet-type mediums so as to form a sheet-type medium stack within a time period of T2. Then the clamping and conveying mechanism clamps and conveys the arranged sheet-type medium stack to the bundling mechanism, and it takes a time period of T3 for the bundling mechanism to perform the bundling operation. Next, it takes the clamping and conveying mechanism a time period of T4 to convey the bundled sheet-type medium stack out. That is, an operation cycle of a traditional sheet-type medium bundling device is a total time period of Tt (cycle time)=T1 (stacking time)+T2 (arranging time)+T3 (bundling time)+T4 (outputting time). Therefore this kind of sheet-type medium bundling device is time-consuming and thus has a low efficiency.

In order to reduce the stacking time T1, those skilled in the art usually provide an additional stacking plate to realize a parallel operation solution by utilizing two stacking plates alternately for the stacking and the bundling. However, in this type of sheet-type medium bundling device, a mechanical pushing member is required for switching the stacking plates between two positions successively and repeatedly. Further, since the distance between the two positions is large, this type of sheet-type medium bundling device system is complicated and occupies too much space.

Therefore, there is an urgent demand to provides a sheet-type medium bundling device which can solve the above problems while being less time consuming, high in efficiency and space saving.

SUMMARY OF THE INVENTION

In view of this, an object of the present application is to provide a sheet-type medium bundling device which is less time consuming, high in efficiency and space saving.

In order to achieve the above object, it is provided according to the present application a sheet-type medium bundling device for a cooperative operation of stacking and bundling of sheet-type mediums. The sheet-type medium bundling device includes: a conveying passage, a bundling mechanism, a position switching mechanism, a stacking position formed at an end of the conveying passage, and a bundling position formed corresponding to the bundling mechanism. Wherein the conveying passage, the bundling mechanism and the position switching mechanism are mounted on a frame. The position switching mechanism includes a power shaft driven by a motor and at least two stacking plates evenly provided on the power shaft, and when one of the stacking plates is located at the stacking position, another one of the stacking plates is located at the bundling position.

Preferably, the power shaft is provided with a mounting shaft sleeve, on which the stacking plates are fixedly mounted. Each stacking plate is of a "U" shape or a "V" shape and is opened outwards. Each stacking plate includes a guiding surface located upstream of the power shaft and a stacking surface located downstream of the power shaft. An end of the guiding surface is bent towards an upstream direction of the power shaft, such that a guiding surface at the stacking position is contiguous with the end of the conveying passage, thereby guiding every single sheet of sheet-type medium out of the conveying passage to stack the sheet-type mediums on the stacking surface at the stacking position. The guiding surface, on one hand, is configured for guiding the sheet-type medium conveyed from the conveying passage, and on the other hand, is configured for blocking the sheet-type medium on the stacking surface, to prevent the sheet-type medium on the stacking surface from leaving the stacking surface in a position switching operation.

Preferably, a code disc is mounted at an end of the power shaft, and the code disc is provided thereon with notches corresponding to the stacking plates. A sensor for sensing the information of the notches is mounted at a position corresponding to the code disc. By means of the code disc and the sensor, a specific location of each stacking plate on the position switching mechanism can be monitored in real time, thereby ensuring the accuracy of position switching of the position switching mechanism.

Preferably, the number of the stacking plates is six, and the stacking position and the bundling position correspond to two adjacent stacking plates. Since the six stacking plates are evenly provided on the power shaft, and the stacking position and the bundling position correspond to two adjacent stacking plates, the angle between the stacking position and the bundling position is 60°, thereby the structure is compact, which effectively saves the space occupied by the sheet-type medium bundling device.

A falling position is formed downstream of the bundling position, and a falling plate is obliquely mounted at a position corresponding to the falling position. Because of the inclined arrangement of the falling plate, the sheet-type medium stack on the stacking plate moved to the stacking position is blocked by the falling plate and slides freely along the falling plate, thereby completing the falling operation of the present application.

Preferably, each stacking plate is provided with a groove, and one end of the falling plate extends towards a direction of the groove to form a blocking arm which blocks the sheet-type medium stack on the stacking plate, such that the sheet-type medium stack falls onto the falling plate, and the other end of the falling plate corresponds to a position of a container for storing a sheet-type medium stack to guide the sheet-type medium stack to fall into the container. When a stacking plate passes the falling position, the blocking arm of the falling plate passes through the groove in the stacking plate to block the sheet-type medium stack on the stacking plate such that the sheet-type medium stack slides automatically along the falling plate to the container to be stored therein. Therefore, it substantially takes no time for the falling operation of the present application, and the sheet-type medium bundling device according to the present application has a compact structure and occupies a small space.

A long side arranging mechanism is mounted at a position corresponding to the stacking position, and a short side arranging mechanism is mounted at a position corresponding to the bundling position. The long side arranging mechanism and the short side arranging mechanism are configured for arranging the sides of the sheet-type mediums, to facilitate the clamping and conveying and the bundling of the sheet-type mediums. Therefore the sheet-type medium bundling device according to the present application has a compact structure and occupies a small space.

A clamping and conveying mechanism is mounted at a position corresponding to the bundling position, and the clamping and conveying mechanism clamps and conveys the sheet-type medium stack at the bundling position to the bundling mechanism.

Preferably, the clamping and conveying mechanism includes a motor, a synchronous belt, a slide shaft and a clamp assembly. Wherein, the slide shaft is parallel to a stacking plate at the stacking position, and one end of the slide shall is mounted on a mounting frame at a left side of the position switching mechanism, the other end of the slide shaft is mounted on a fixing frame at a right side of the position switching mechanism. The clamp assembly is slidably mounted on the slide shaft. The motor is connected to the synchronous belt to drive the synchronous belt to move. The synchronous belt is connected to the clamp assembly to drive the clamp assembly to slide along the slide shaft. And the clamp assembly is configured to clamp the sheet-type medium stack at the bundling position and convey the sheet-type medium stack to the bundling mechanism.

Particularly, a sensor is mounted on the mounting frame for detecting an initial position of the clamp assembly. The sensor facilitates the control of the sheet-type medium bundling device according to the present application.

Particularly, the clamp assembly includes: a sliding block slidably mounted on the slide shaft and fixedly connected to the synchronous belt; a clamping frame fixedly connected to the sliding block; an upper clamping plate and a lower clamping plate, each of which being elastically connected to the clamping frame and can rotate about a rotary shaft; and a guiding plate, one end of the guiding plate being fixedly mounted on the mounting frame, and the other end of the guiding plate being formed with a guiding head having a guiding inclined surface. Two limiting sliding blocks are correspondingly mounted on the opposite surfaces of the upper clamping plate and the lower clamping plate. The guiding plate guides, via the guiding head, the upper clamping plate and the lower clamping plate to open and is supported in an angle formed by the two limiting sliding blocks 373. During the clamping and conveying of the sheet-type medium stack, the synchronous belt drives the upper clamping plate and the lower clamping plate to move towards the bundling position through the sliding blocks. After a certain distance, the two limiting sliding blocks are disengaged from the guiding plate, such that the upper clamping plate and the lower clamping are rotated towards each other under the elastic forces, thereby clamping the sheet-type medium stack. When releasing the sheet-type medium stack, the synchronous belt drives the upper clamping plate and the lower clamping plate to move towards the mounting frame along the slide shaft, such that the two limiting sliding blocks slide along the guiding inclined surface of the guiding head, thereby the upper clamping plate and the lower clamping plate are gradually opened.

Further, each stacking plate is provided with a groove, and the ends of the upper clamping plate and the lower clamping plate are bent towards directions of the grooves to form an upper clamping block and a lower clamping block opposite to each other. The groove is configured for providing a space for the clamp assembly to clamp or release the sheet-type mediums.

Further, a supporting plate is provided perpendicularly between the upper clamping plate and the lower clamping plate, and the supporting plate can rotate about a rotary shaft and is elastically mounted on the upper clamping pate. A blocking plate is mounted at a position corresponding to the supporting plate, and the blocking plate can rotate about a rotary shaft and is elastically connected to the frame. When the clamp assembly is moved along the slide shaft, the supporting plate collides with the blocking plate until the supporting plate is rotated and is disengaged from the lower clamping plate. After the limiting sliding blocks on the upper clamping plate and the lower clamping plate are disengaged from the guiding plate, the upper clamping plate and the lower clamping plate are maintained in an open state by the supporting assembly. When the upper clamping plate and the lower clamping plate are moved to a position to performing the clamping operation, the supporting plate collides with the blocking plate, and is rotated and thus disengaged from the lower clamp plate under the blocking of the blocking plate. At this time, the upper clamping plate and the lower clamping plate lose the supporting of the supporting plate, thereby clamping the sheet-type medium stack instantly, to prevent the sheet-type mediums from being deformed by the upper clamping plate and the lower clamping plate.

Further, the two limiting sliding blocks form a guiding angle cooperating with the guiding head. The guiding angle is designed to facilitate the opening of the upper clamping plate and the lower clamping plate when the clamp assembly is restored to its original position (that is, being located at a left side of the bundling position).

Compared with the prior art, the sheet-type medium bundling device of the present application achieves a cooperative operation of stacking and bundling of the sheet-type mediums by utilizing the position switching mechanism, and connects the stacking position with the bundling position through rotations of the stacking plates of the position switching mechanism, thereby finishing the switching between the stacking and the bundling operations of the sheet-type medium and achieving a parallel performing of the operations, which not only reduces the total time required for processing a stack of the sheet-type mediums and increase the operation efficiency, but greatly saved the space occupied by the present application. On one hand, the stacking plates are evenly provided on the power shaft, and after each position switching, two of the stacking plates are respectively located at the stacking position and the bundling position, such that the stacking and the bundling operations of the sheet-type mediums can be performed simultaneously, thereby effectively increasing the operation efficiency of the sheet-type medium bundling device. On the other hand, after completing the collection of the sheet-type mediums by the stacking plate at the stacking position, the stacking plate having completed the collection can be switched to the bundling position as long as the power shaft is rotated, thereby can achieve a repeated circulation of the stacking plate between the stacking position and the bundling position, which can solve the problem that the system is complicated and occupies too much space due to the long distance between the stacking position and the bundling position in the prior art, and can save the space.

DETAILED DESCRIPTION

Figure 1:
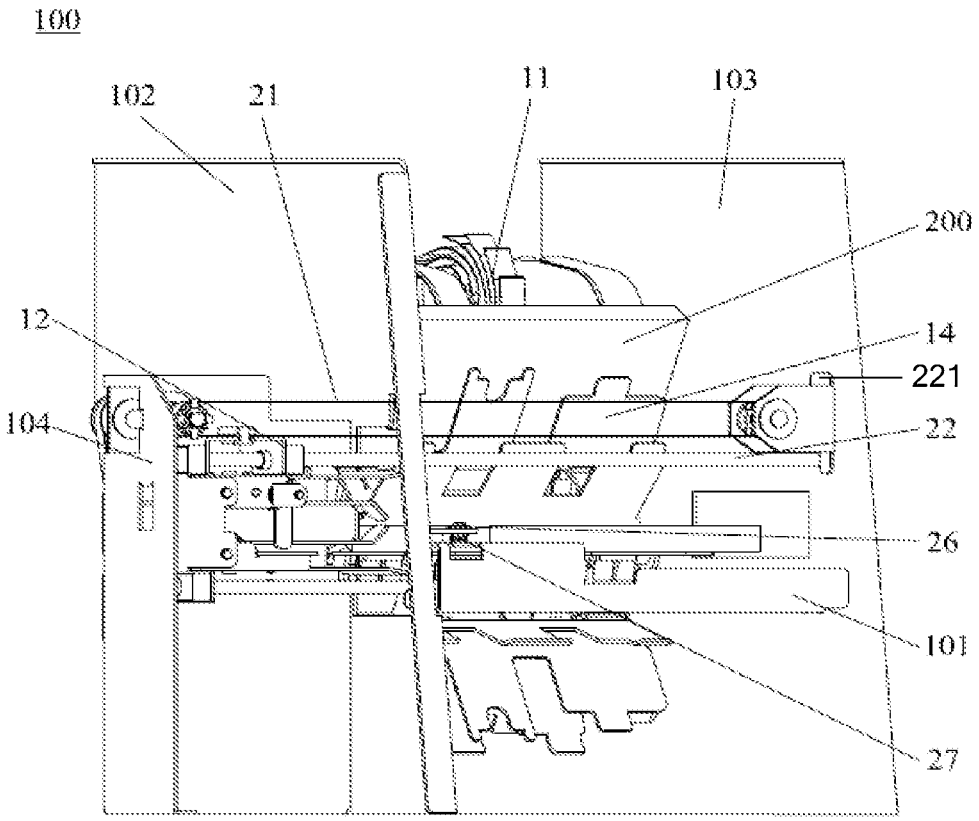
FIG. 1 is a perspective view of a sheet-type medium bundling device according to the present application.

Hereinafter, the embodiments will be described in detail in conjunction with the drawings to describe the technical disclosure, the structural characteristics, and the effects and the object to be achieved.

Referring to FIG. 1 to FIG. 5, a sheet-type medium bundling device 100 according to the present application is configured for a cooperative operation of stacking and bundling of sheet-type mediums. The sheet-type medium bundling device 100 includes: a conveying passage 11, a bundling mechanism 13; a stacking position 61 formed at an end of the conveying passage 11 and configured for the stacking of the sheet-type mediums, a bundling position 62 formed at a position corresponding to the bundling mechanism 13 for the bundling of the sheet-type mediums, and a position switching mechanism 14 which connects the stacking position 61 with the bundling position 62. The position switching mechanism 14 includes a power shall 41 and at least two stacking plates mounted on the power shaft 41. The power shaft 41 is connected to an output shaft of a motor and is driven, by the motor, to rotate. The at least two stacking plates are evenly provided on the power shaft 41, and when one of the stacking plates is located at the stacking position 61, another one of the stacking plates correspondingly is located at the bundling position 62. In operating (it is preset that the stacking plate 51 is located at the stacking position 61), every single sheet of sheet-type medium is conveyed to the stacking plate 51 at the stacking position 61 by the conveying mechanism 11, and is collected by the stacking plate 51. When the amount of the sheet-type mediums to be stacked reaches to a limit value, the power shaft 41 drives the stacking plates to switch the positions of the stacking plates. After the position switching, the stacking plate 51 is switched to a downstream position, and a stacking plate, which is located upstream of the stacking plate 51, is rotated to the stacking position 61 for the stacking operation. The stacking plate 51 or a stacking plate located downstream of the stacking plate 51 and carries a sheet-type medium stack 200 is moved to the bundling position 62 for the bundling operation and so on. Thereby finishing the switch between the stacking and the bundling of the sheet-type mediums, which achieves the parallel operation of stacking and bundling, increases the operation efficiency and saves the occupied space.

Figure 4:
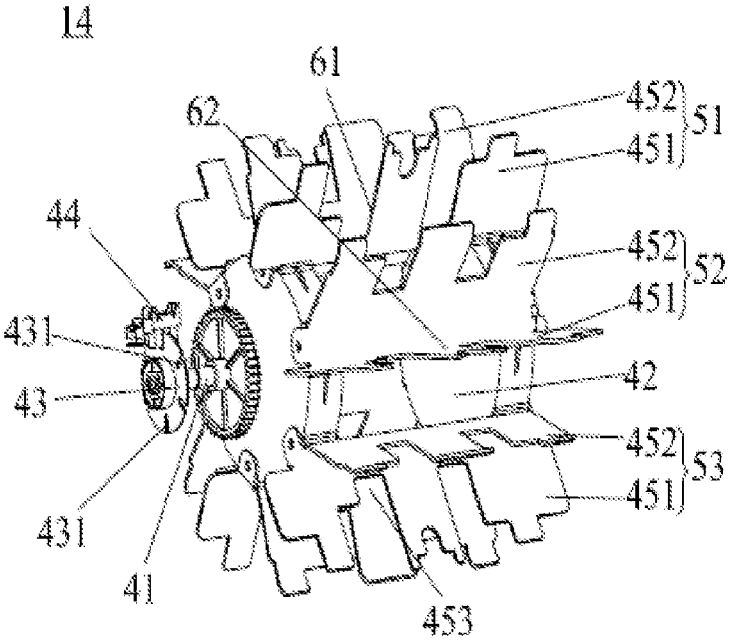
FIG. 4 is a perspective view of a position switching mechanism according to the present application.
Figure 5:
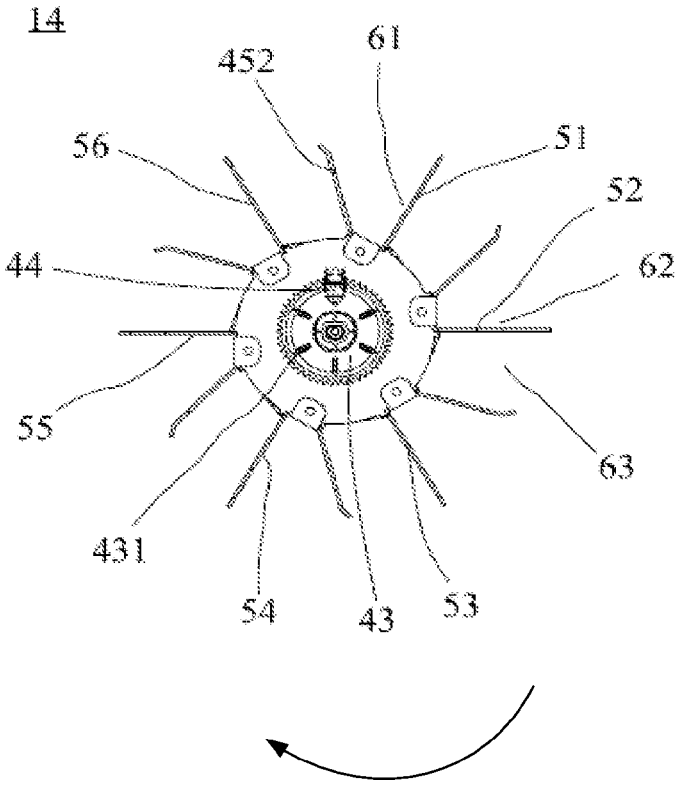
FIG. 5 is a side view of a position switching mechanism according to the present application.

Preferably, referring to FIG. 4 and FIG. 5, the power shaft 41 is provided with a mounting shaft sleeve 42, and the stacking plates are fixedly mounted on the mounting shaft sleeve 42. Each stacking plate is of a "U" shape or a "V" shape and is opened towards outside. Each stacking plate includes a guiding surface 452 located upstream of the power shaft 41 and a stacking surface 451 located downstream of the power shaft 41. An end of the guiding surface 452 is bent towards an upstream direction of the power shaft 41 such that the guiding surface 452 at the stacking position 61 is contiguous with the end of the conveying passage 11, thereby guiding every sheet of sheet-type medium out of the conveying passage 11 to stack the sheet-type mediums on the stacking surface 451 at the stacking position 61. During the position switching, the power shaft 41 is rotated, by the motor, in a direction of an arrow shown in the FIG. 5, the power shaft 41 in turn drives the mounting shaft sleeve 42 to rotate together, and the mounting shaft sleeve 42 rotates each stacking plate to a next position.

Preferably, referring to FIG. 4 and FIG. 5, a code disc 43 is mounted at an end of the power shaft 41, and the code disc is provided thereon with notches 431 corresponding to the stacking plates. A sensor 44 for sensing the information of the notches 431 is mounted at a position corresponding to the code disc 43. During the position switching, the code disc 43 rotates with the power shaft 41, and the sensor 44 determines the specific state of the position switching by detecting the information of the notches 431.

Preferably, referring to FIG. 4 and FIG. 5, in the present embodiment, six stacking plates are provided, and the six stacking plates 51, 52, 53, 54, 55 and 56 are evenly provided on the mounting shaft sleeve 42 in an axial direction of the power shaft 41. The stacking position 61 and the bundling position 62 correspond to two adjacent stacking plates, respectively. Referring to in an initial state, the stacking plate 51 is located at the stacking position 61, the stacking plate 52 is located at the bundling position, and a falling position 63 is located downstream of the stacking plate 52. Although the number of the stacking plates may be two or more, preferably, four or more than four stacking plates are provided to ensure the stability of the conveying of the stack of sheet-type mediums 200 on the stacking plate. Further, in order to simplify the structure of the present application and facilitate the arrangement, it is proper that the number of the stacking plates is 4 to 8, and it is optimal that the number of the stacking plate is 6.

Figure 3:
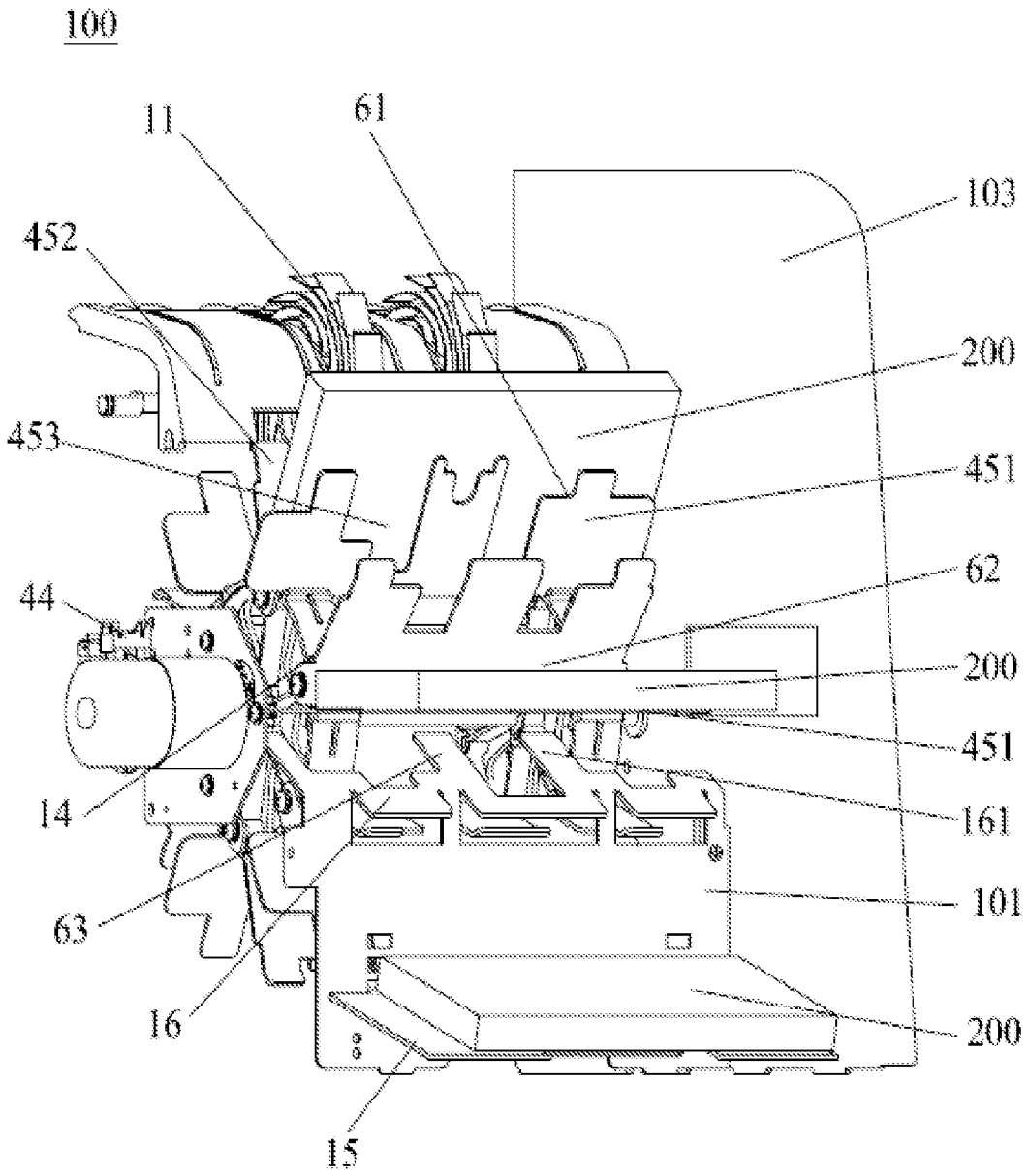
FIG. 3 is a perspective view of a sheet-type medium bundling device according to the present application with a left side plate being removed.

Referring to FIG. 3, the falling position 63 for the output of the sheet-type mediums is formed downstream of the bundling position 62, and a falling plate 16 is obliquely mounted at the falling position 63. Furthermore, each stacking plate is provided with a groove 453, and one end of the falling plate 16 extends towards a direction of the groove 453 to form a corresponding blocking arm 161. The blocking arm 161 guides the sheet-type medium stack 200 on the stacking plate such that the sheet-type medium stack falls onto the falling plate 16. The other end of the falling plate 16 corresponds to the position of a container 15 to guide the sheet-type medium stack 200 on the falling plate 16 to slide into the container 15 along the inclined plate surface.

Figure 2:
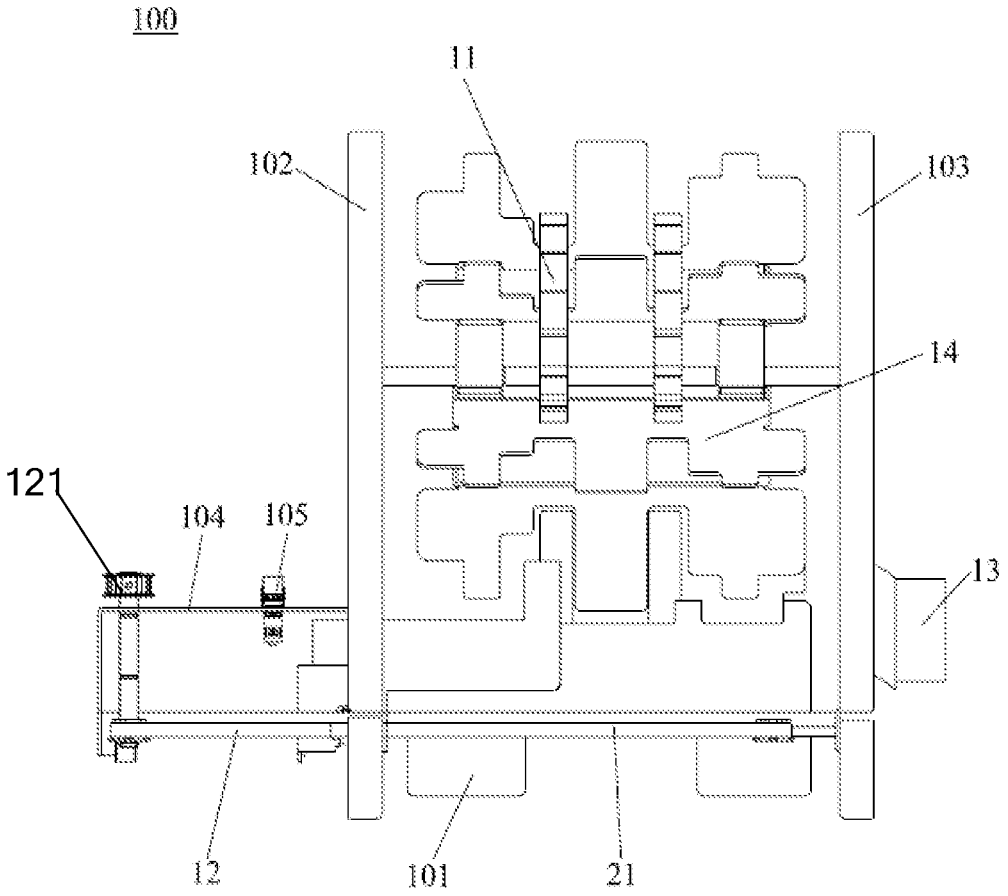
FIG. 2 is a top view of a sheet-type medium bundling device according to the present application.

Referring to FIG. 1 to FIG. 3, a long side arranging mechanism (not shown) is mounted at a position corresponding to the stacking position 61, a short side arranging mechanism (not shown) is mounted at a position corresponding to the bundling position 62, and a clamping and conveying mechanism 12 and the bundling mechanism 13 are mounted at positions corresponding to the bundling position 62.

Referring to FIG. 1 to FIG. 3, the clamping and conveying mechanism 12 is mounted at the position corresponding to the bundling position 62. The arranging mechanisms (not shown), the conveying passage 11, the clamping and conveying mechanism 12, the bundling mechanism 13, the position switching mechanism 14, the container 15 and the falling plate 16 are all mounted on a frame 101. The conveying passage 11 is configured for conveying every single sheet of sheet-type medium to a stacking plate at the stacking position 61. The long side arranging mechanism and the short side arranging mechanism are configured for arranging the long side and the short side of the sheet-type medium stack on the stacking plate. The clamping and conveying mechanism 12 is configured for clamping the arranged sheet-type medium stack 200 and conveying them to the bundling mechanism 13. The bundling mechanism 13 is configured for the bundling of the sheet-type medium stack 200. The falling plate 16 is configured for unloading the bundled sheet-type medium stack 200 from the stacking plate. The container 15 is configured for storing the bundled sheet-type medium stack 200. And the position switching mechanism 14 is configured for circulating each stacking plate through the stacking position 61, the bundling position 62 and the falling position 63 successively and repeatedly, thereby achieving the successive switching of four different operations, that is, the stacking, the arranging, the bundling and the falling operations, of the sheet-type mediums.

Referring to FIG. 1 and FIG. 2, the frame 101 includes a left side plate 102 and a right side plate 103 located at two sides of the position switching mechanism 14, and a mounting frame 104 is mounted at an outer side of the left side plate 102.

Particularly, referring to FIG. 1 to FIG. 2 and FIG. 6 to FIG. 8, the clamping and conveying mechanism 12 includes a motor (not shown), a synchronous belt 21, a slide shaft 22 and a clamp assembly 23. The slide shaft 22 is parallel to a stacking plate at the bundling position 62, and one end of the slide shaft 22 is mounted on the mounting frame 104, the other end of the slide shaft 22 passes through the lift side plate 102 and is mounted on a fixing frame 221 at the right side of the position switching mechanism 14. The clamp assembly 23 is slidably mounted on the slide shaft 22 and corresponds to the position of the bundling mechanism 13. The mounting frame 104 is fit with a sensor 105 for detecting an initial position of the clamp assembly 23. In operating, the motor 121 is connected to the synchronous belt 21 and drives the synchronous belt 21 to move. The synchronous belt 21 is fixedly connected to the clamp assembly 23 and drives the clamp assembly 23 to slide at the bundling position 62 along the slide shaft 22. The clamp assembly 23 clamps a sheet-type medium stack 200 on a stacking surface 451 at the bundling position 62. The synchronous belt 21 conveys the clamped sheet-type medium stack 200 to the bundling mechanism 13 and conveys the bundled sheet-type medium stack 200 back to the position of the sheet-type medium stack 200 before being clamped. The bundling position 62 is in a horizontal state for facilitating the clamping and conveying and the bundling of the sheet-type medium.

Figure 6:
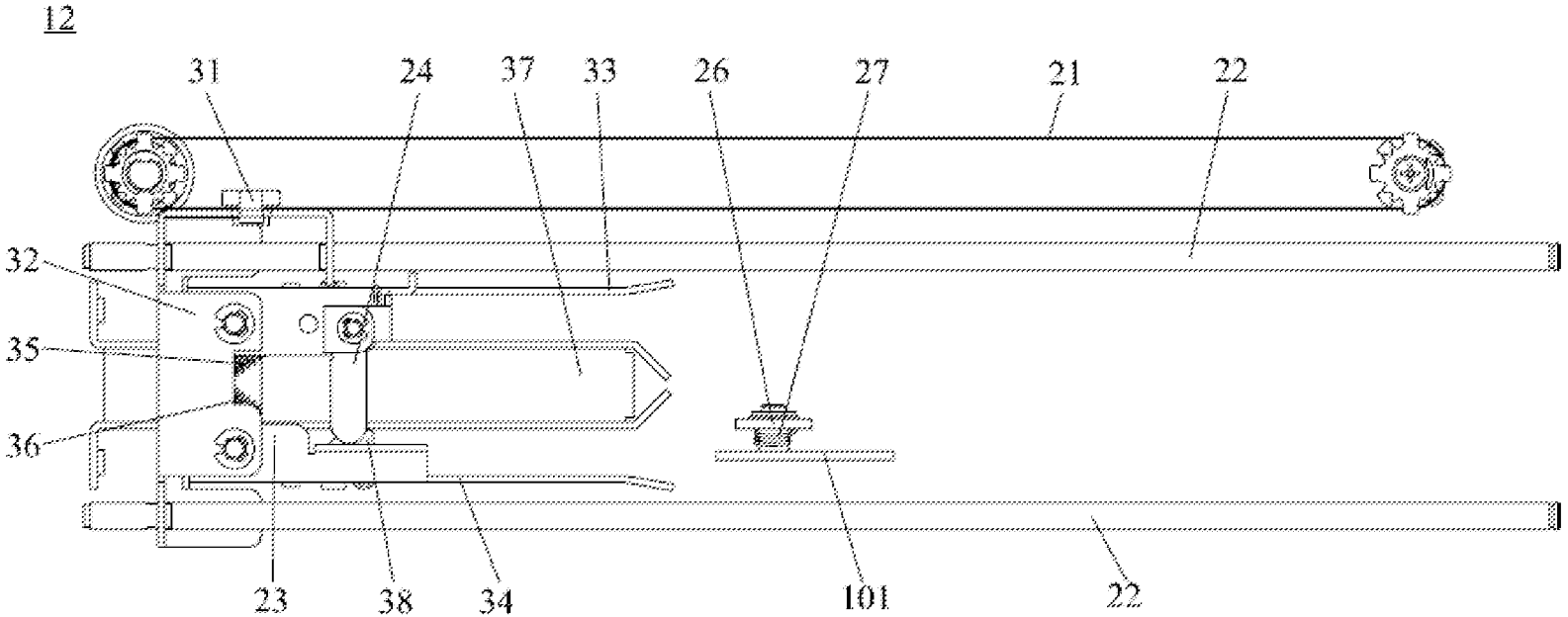
FIG. 6 is a front view of a clamping and conveying mechanism according to the present application.
Figure 7:
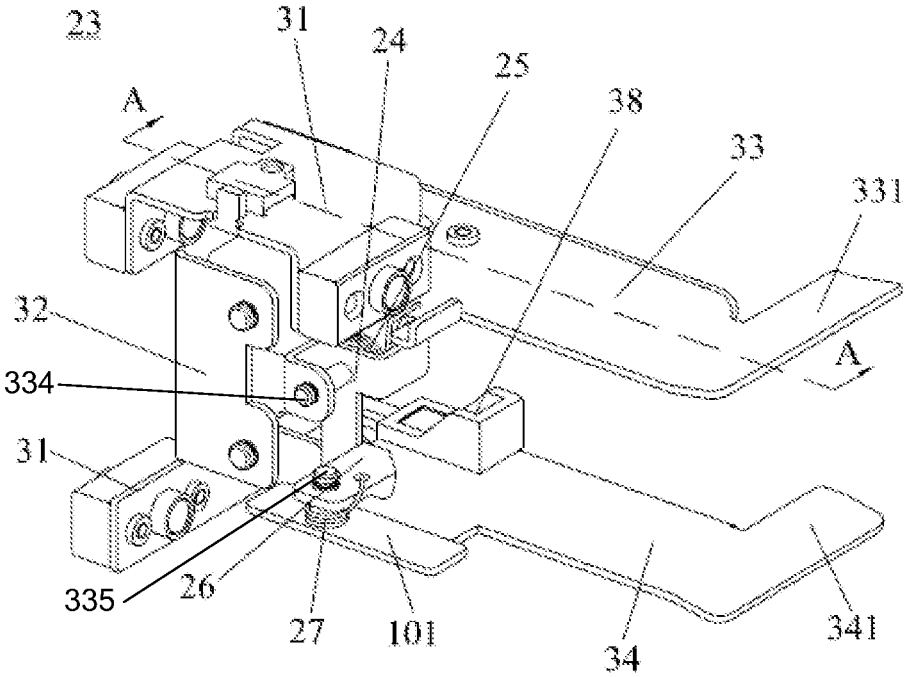
FIG. 7 is a perspective view of a clamp assembly according to the present application.
Figure 8:
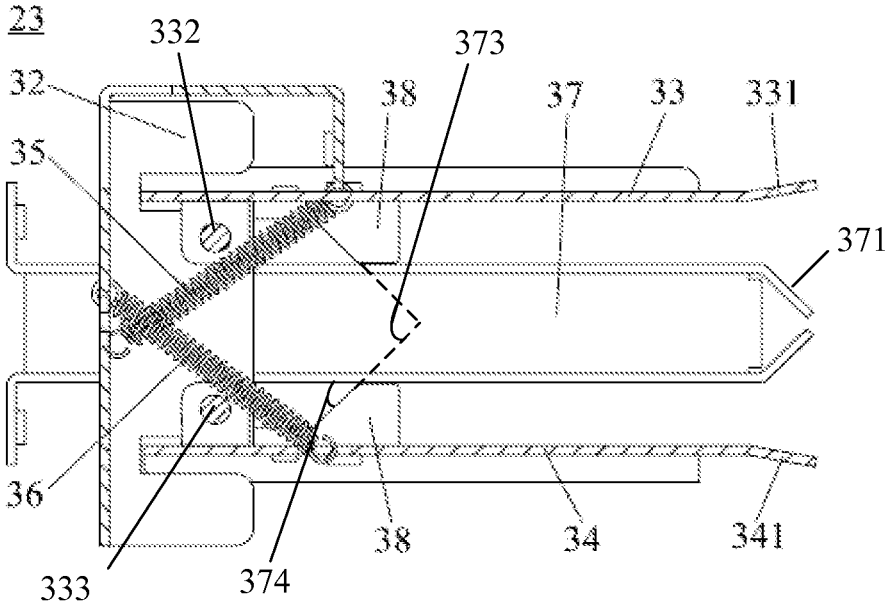
FIG. 8 is a sectional view of the clamp assembly taken along line A-A in FIG. 7.

More particularly, referring to FIG. 6 to FIG. 8, the clamp assembly 23 includes: a sliding block 31 slidably mounted on the slide shaft 22 and fixedly connected to the synchronous belt 21, a clamping frame 32 fixedly connected to the sliding block 31, an upper clamping plate 33 which can rotate about a rotary shaft 332 and is elastically connected to the clamping frame 32 is an elastic element 35, a lower clamping plate 34 which can rotate about a rotary shaft 333 and is elastically connected to the clamping frame 32 via an elastic element 36, and a guiding plate 37. One end of the guiding plate 37 is fixedly mounted on the mounting frame 104, and the other end of the guiding plate 37 is formed with a guiding head with a guiding inclined surface. Two limiting sliding blocks 38 are correspondingly mounted on the opposite surfaces of the upper clamping plate 33 and the lower clamping plate 34. The guiding plate guides, via the guiding head, the upper clamping plate 33 and the lower clamping plate 34 to open and is supported by the two limiting sliding blocks 38 forming an angle. During the clamping and conveying of the sheet-type medium stack 200, the synchronous belt 21 drives the clamping frame 32 of the clamp assembly 23 to slide rightwards along the slide shaft 22, and the upper clamping plate 33 and the lower clamping plate 34 are driven to move towards the bundling position 62 together with the clamping frame. When the limiting sliding blocks 38 is disengaged from the guiding plate 37, the upper clamping plate 33 and the lower clamping plate 34 rotate towards each other under the actions of the elastic elements 35 and 36, such that the clamp assembly 23 clamps the sheet-type medium stack 200 (referring to FIG. 9*e*). When releasing the sheet-type medium stack 200, the synchronous belt 21 drives the upper clamping plate 33 and the lower clamping plate 34 to move towards the mounting frame 104 along the slide shaft 22, and the two limiting sliding blocks 38 are driven to slide along the guiding inclined surface 371 of the guiding head, such that the upper clamping plate 33 and the lower clamping plate 34 are gradually opened to release the sheet-type medium stack 200 (referring to FIG. 9*g*).

Preferably, ends of the upper clamping plate 33 and the lower clamping plate 34 are bent towards directions of the grooves 453, to form an upper clamping block 331 and a lower clamping block 341 opposite to each other.

Preferably, a guiding angle 374 is formed between the two limiting sliding blocks 38. The guiding angle is formed to cooperate with the guiding head and is opened towards the clamping frame 32. When releasing the sheet-type medium stack 200, two inclined surfaces of the guiding angle slide along the guiding inclined surface of the guiding head, such that the upper clamping plate 33 and the lower clamping plate 34 are gradually opened, thereby releasing the sheet-type medium stack 200.

Preferably, a supporting plate 24 is perpendicularly provided between the upper clamping plate 33 and the lower clamping plate 34. The supporting plate 24 can rotate about a rotary shaft 334 and is elastically mounted to the upper clamping plate 33 via an elastic element 25. A blocking plate 26 is provided at a position corresponding to the supporting plate 24. The blocking plate 26 can rotate about a rotary shaft 335 and is elastically connected to the frame 101 via an elastic element 27. When the clamp assembly 23 moves towards the bundling mechanism 13, the limiting sliding blocks 38 are disengaged from the guiding plate 37, and the upper clamping plate 33 and the lower clamping plate 34 are maintained in the open state under the action of the supporting plate 24. When the upper clamping block 331 and the lower clamping block 341 at the ends of the upper clamping plate 33 and the lower clamping plate 34 enter the ranges of the grooves 453 of the stacking plates 51, 52, 53, 54, 55, 56, the supporting plate 24 collides with the blocking plate 26, such that the supporting pate 24 is rotated under the blocking action of the blocking plate 26 and is disengaged from the lower clamping plate 34. At this time, the upper clamping plate 33 and the lower clamping plate 34 lose the supporting of the supporting pate 24, thereby closely clamping the sheet-type mediums stack instantly under the actions of the elastic elements 35 and 36, to prevent the sheet-type mediums from being deformed by the upper clamping plate 33 and the lower clamping plate 34. When the clamp assembly 23 moves in a direction away from the bundling mechanism 13, the blocking plate 26 rotates such that, with the opening of the upper clamping plate 33 and the lower clamping plate 34, the supporting plate 24 is rotated under the restoring force of the elastic member 25 and thus supports the upper clamping plate 33 and the lower clamping plate 34.

Figure 9A:
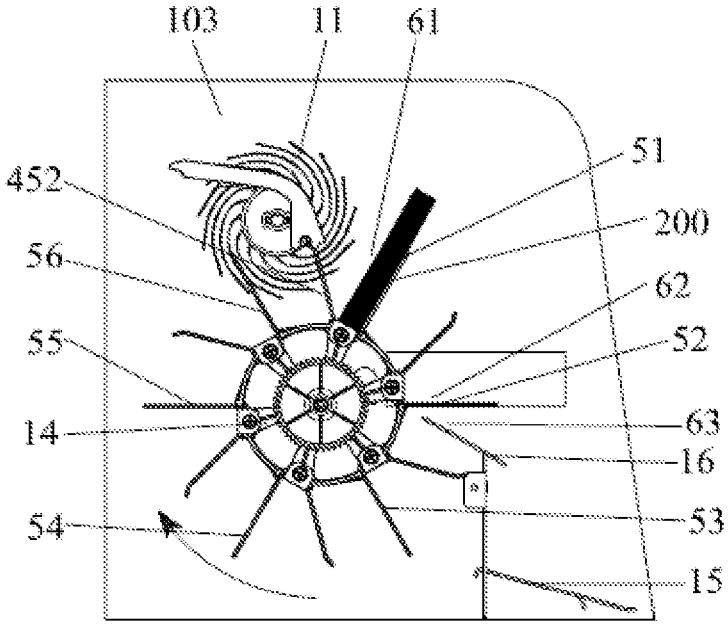
FIGS. 9*a*-9*h* are operation schematic diagrams of the sheet-type medium bundling device according to the present application.

Referring to FIG. 9*a* to FIG. 9*h*, the operation processes of stacking, arranging, bundling, and outputting the sheet-type medium by the sheet-type medium bundling device 100 of the present application will be described in detail. Referring to FIG. 9*a*, in an initial state, the stacking plate 51 is located at the stacking position 61, the stacking plate 52 is located at the bundling position 62, and the falling position 63 is located downstream of the stacking plate 52. The present application includes the following steps:

Referring to FIG. 9*a*, every single sheet of sheet-type medium is conveyed by the conveying passage 11 to the stacking plate 51 at the stacking position 61 and is stacked on the stacking plate 51. Meanwhile, the long side arranging mechanism is extended to the stacking position 61 to perform the flapping and arranging operation. When the amount of the sheet-type mediums to be stacked reaches to a limit value and forms a sheet-type medium stack 200, a corresponding control system sends a signal such that the conveying passages stop conveying the sheet-type medium and the long side arranging mechanism returns to its original position.

Figure 9B:
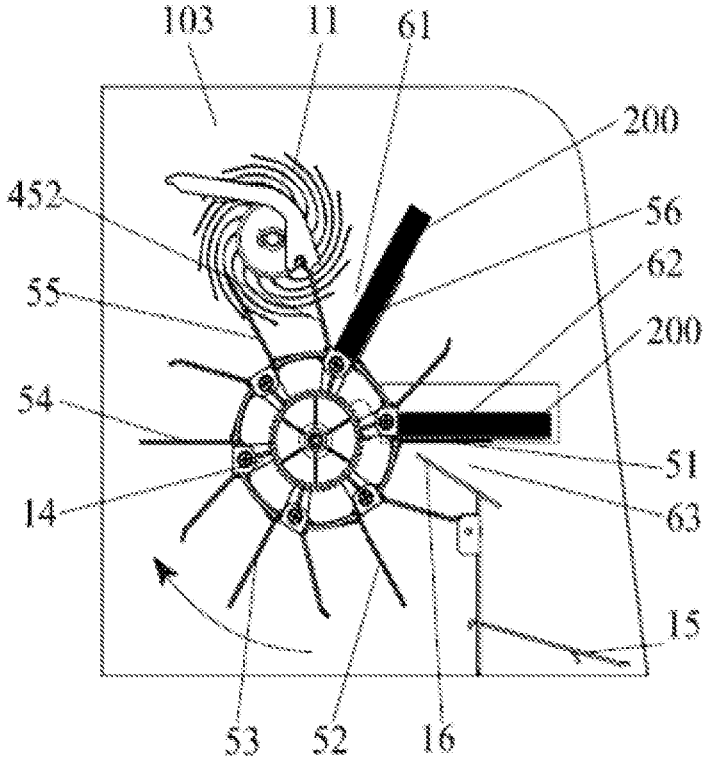

Referring to FIG. 9*b*, when the sheet-type medium stack 200 is stacked by the stacking plate 51 at the stacking position 61, the position switching mechanism 14 is rotated clockwise to switch each stacking plate to a next position, such that the stacking plate 51 at the stacking position 61 is moved to the bundling position 62, the stacking plate 56 is moved to the stacking position 61, and the stacking plate 52 is moved to an original position of the stacking plate 53 after passing the blocking arm 161 of the falling plate 16, thereby the position switching operation is completed.

Figure 9C:
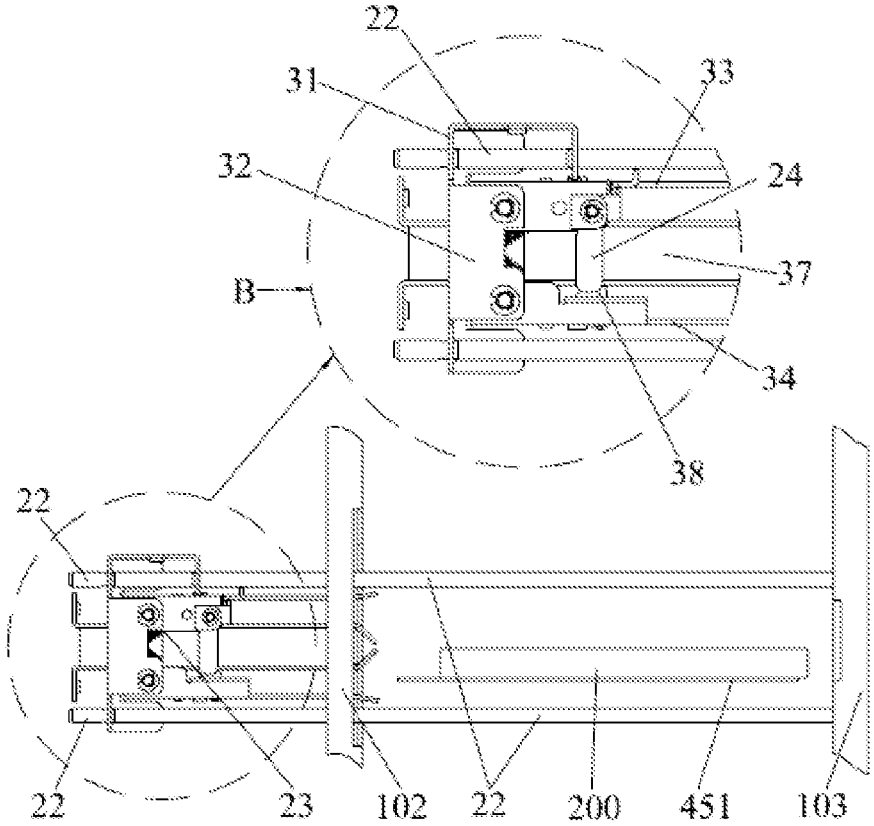

After the position switching operation is completed, the conveying passage 11 continues to convey the sheet-type mediums which are then collected by the stacking plate 56. At the same time, referring to FIG. 9*c* to FIG. 9*g*, the short side arranging mechanism is extended to flap and arrange the sheet-type medium stack 200. Then the sheet-type mediums stack 200 is clamped by the clamp assembly 23 of the clamping and conveying mechanism 12 and is conveyed to the bundling mechanism 13 through the opening in the right side plate 103. After being bundled, the sheet-type medium stack 200 is pulled back, by the clamp assembly 23 of the clamping and conveying mechanism 12, to its original position before being clamped. Hereinafter, the operation process of the clamping and conveying mechanism 12 will be described in detail, including the following steps:

(1) Referring to FIG. 9*c*, before receiving a signal indicating that the position switching has been completed from the sensor 44, the clamp assembly 23 stays at the left side of the left side plate 102. At this time, the limiting sliding blocks 38 and the supporting plate 24 cooperates to maintain the opening state of the upper clamping plate 33 and the lower clamping plate 34.

Figure 9D:
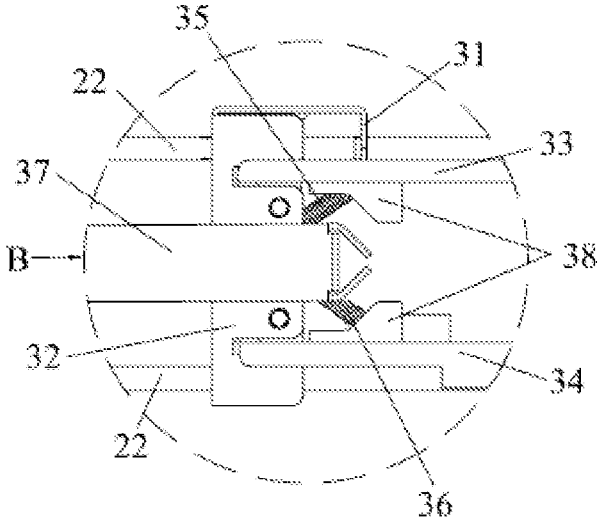

(2) Referring to FIG. 9*d*, after the sheet-type medium stack 200 has been flapped and arranged by the short side arranging mechanism, the control system sends a signal to activate the clamping and conveying mechanism 12. Then the clamp assembly 23 is moved rightwards along the slide shaft 22. When the limiting sliding blocks 38 is disengaged from the guiding plate 37, the upper clamping plate 33 and the lower clamping plate 34 are supported by the supporting plate 24, thus being maintained in the opening state.

Figure 9E:
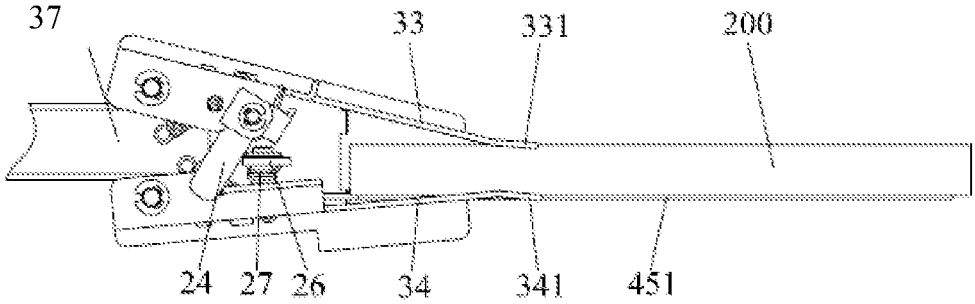

(3) Referring to FIG. 9*e*, when the upper clamping block 331 and the lower clamping block 341 enter the range of the groove 453 of the stacking plate 51, the supporting plate 24 is blocked by the blocking plate 26 and is rotated clockwise, such that the upper clamping plate 33 and the lower clamping plate 34 lose the supporting of the supporting plate, thereby clamping the sheet-type medium stack 200 instantly.

Figure 9F:
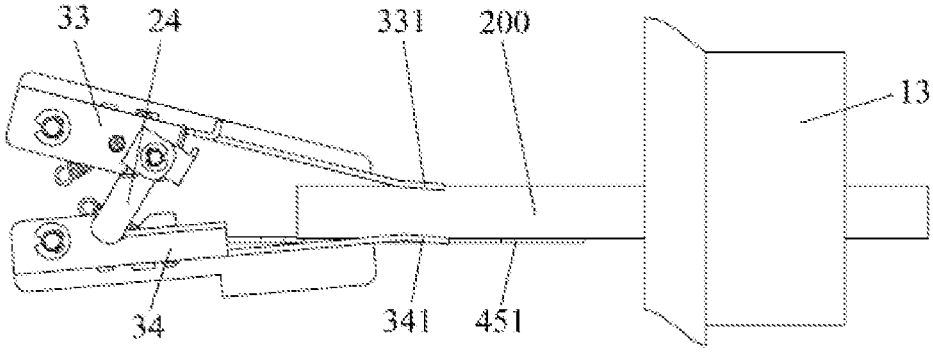

(4) Referring to FIG. 9*f*, the clamp assembly 23 continues to slide rightwards, the upper clamping plate 33 and the lower clamping plate 34 clamp the sheet-type medium stack 200 and convey the sheet-type medium stack 200 to the bundling mechanism 13 along the surface of the stacking plate 51.

Figure 9G:
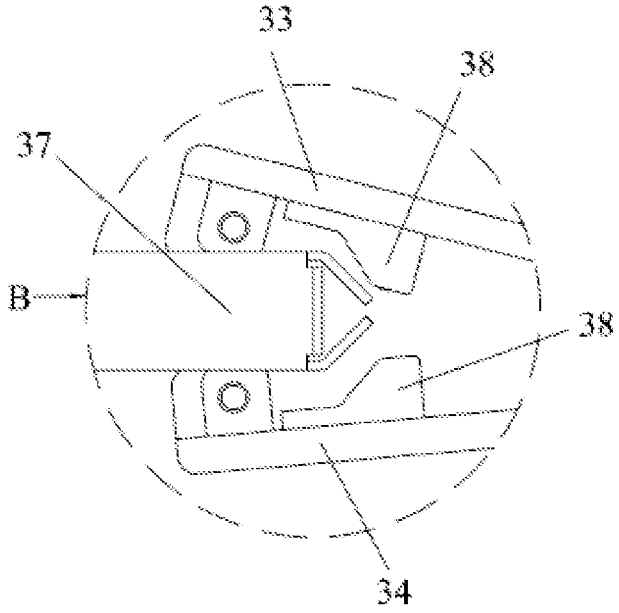

(5) Referring to FIG. 9*g*, after the sheet-type medium stack 200 has been bundled, the clamping and conveying mechanism 12 receives an instruction from the control system to control the synchronous belt 21 to rotate reversely, such that the clamp assembly 23 pulls the sheet-type mediums stack 200 to move reversely. When the supporting plate 24 collides with the blocking plate 26, the blocking plate 26 is rotated counterclockwise to make out of the way. When the upper clamping block 331 and the lower clamping block 341 enter the groove 453 of the stacking plate 51, the limiting sliding blocks 38 slide along the inclined surface of the guiding head of the guiding plate 37, such that the upper clamping plate 33 and the lower clamping plate 34 are gradually opened, the supporting plate 24 is restored under the action of the elastic element 25, thereby supporting the upper clamping plate 33 and the lower clamping plate 34.

(6) When the upper clamping plate 33 and the lower clamping plate 34 are opened, the sheet-type medium stack 200 stays on the stacking plate 51 because of losing of the pulling force. The clamp assembly 23 continues to slide leftwards. When the clamp assembly 23 triggers the sensor 105, the control system sends a signal to stop the synchronous belt 21 of the clamping and conveying mechanism 12. At this time, the bundled sheet-type medium stack 200 stays on the stacking plate 51, and sheet-type mediums are continuously stacked by the stacking plate 56.

Figure 9H:
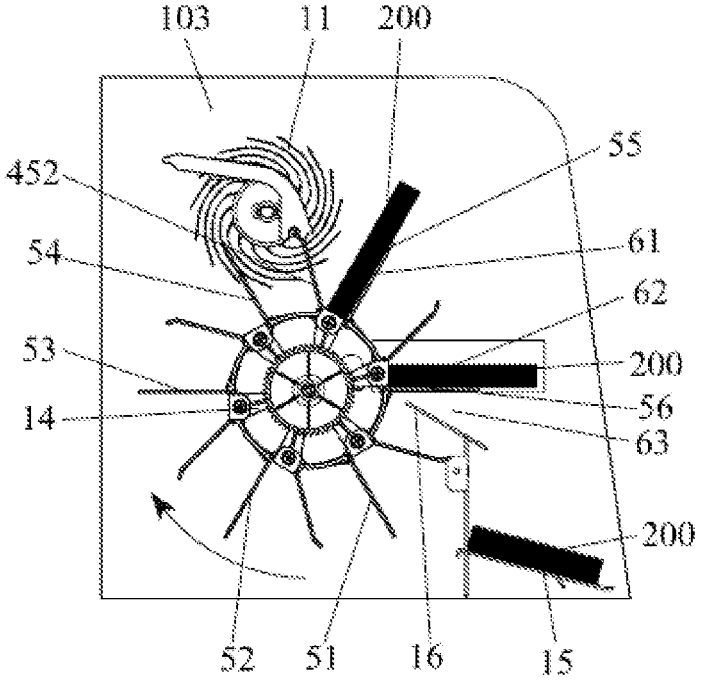

Referring to FIG. 9*h*, when the amount of the sheet-type mediums collected by the stacking plate 56 reaches to the limit value and forms a sheet-type medium stack 200, the position switching mechanism 14 is rotated clockwise again to perform the position switching, the sheet-type medium stack 200 on the stacking plate 51 is rotated together and contacts with the falling plate 16. Under the action of the blocking arm 161 of the falling plate 16, the sheet-type medium stack 200 falls onto the falling plate 16 and slides into the container 15 under the guiding of the falling plate 16. Meanwhile, the sheet-type medium stack 200 on the stacking plate 56 is conveyed to the bundling position 62, for the flapping and arranging operation by the short side arranging mechanism, the clamping and conveying, the bundling and the pulling back operations, and the stacking plate 55 is switched to the stacking position 61 to continue to collect the sheet-type mediums conveyed by the conveying passage 11.

The above-mentioned operations are repeated, thereby performing the stacking, the arranging, the bundling and the falling operations of the sheet-type mediums continuously.

The conveying passage 11 is stopped only when the position switching mechanism 14 performs the position switching operation, which lasts about 0.5 s. When the position switching mechanism 14 begins the position switching, at least two of the stacking, the arranging and the bundling operation are performed synchronously. For example, in FIG. 9*b*, while the sheet-type medium stack 200 on the stacking plate 51 at the stacking position 61 is conveyed to the bundling position 62, the stacking plate 56 is switched to the stacking position. After the position switching is completed, the stacking of the sheet-type mediums on the stacking plate 56 are performed together with the flapping and arranging, the clamping and conveying, the bundling and the pulling back operations of the stack of sheet-type mediums 200 on the stacking plate 51 synchronously. In FIG. 9*h*, the stack of sheet-type mediums 200 on the stacking plate 51 is conveyed into the container 15. At the same time, the sheet-type medium stack 200 on the stacking plate 56 is conveyed to the bundling position 62 by the clamping and conveying mechanism 12, and the stacking plate 55 is switched to the stacking position 61. At this time, the stacking plate 55 is collecting the sheet-type mediums, and the flapping and arranging, the clamping and conveying, the bundling, and the pulling back of the sheet-type medium stack 200 on the stacking plate 56 are also being performed. Therefore, when the position switching mechanism 14 in the sheet-type medium bundling device 100 is performing or has completed the position switching operation, at least two of the of the stacking, the bundling, and the falling of the sheet-type mediums are performed synchronously, which increases the operation efficiency of the present application. The time required for processing a stack of sheet-type mediums is determined by the one of the three positions requiring the longest time. For example, the time required for collecting 100 pieces of sheet-type mediums is T1, the time required for the operation at the bundling position 62 is T3, and it takes no time at the container 105, the sheet-type medium stack fall into the container when the position switching operation is completed. Thereby the total time period is the time for collecting the sheet-type mediums, that is, T1.

To sum up, the sheet-type medium bundling device 100 according to the present application can achieve a repeated circulation of the stacking plates at the stacking position 61, the bundling position 62 and the falling position 63 by virtue of the position switching of the position switching mechanism 14, and thus can achieve the successively switching of the stacking, the arranging, the bundling and the falling operations of the sheet-type mediums, thereby achieving the parallel performing of the operations, which not only reduces the time required for processing the sheet-type mediums, but increases the operation efficiency, simplifies the structure, and saves the occupied space.

The above embodiments are merely the preferred embodiments of the present application, and are not intended to limit the protection scope of the present application. Accordingly, any equivalent variation made within the protection scope of the present application should be deemed to fall into the protection scope of the present application.

What is claimed is:

1. A sheet-type medium bundling device for a cooperative operation of stacking and bundling of sheet-type mediums, comprising a conveying passage and a bundling mechanism which are mounted on a frame, a stacking position formed at an end of the conveying passage, and a bundling position formed corresponding to the bundling mechanism, wherein the sheet-type medium bundling device further comprises a position switching mechanism, the position switching mechanism comprising a power shaft driven by a motor to rotate and at least two stacking plates evenly provided on the power shaft, and if one of the stacking plates is located at the stacking position, another one of the stacking plates is located at the bundling positions;

a clamping and conveying mechanism is mounted at a position corresponding to the bundling position, the clamping and conveying mechanism clamping and conveying the sheet-type medium stack at the bundling position to the bundling mechanism; and the clamping and conveying mechanism comprises a motor, a synchronous belt, a slide shaft and a clamp assembly, wherein, the slide shaft is parallel to a stacking plate at the stacking position, and one end of the slide shaft is mounted on a mounting frame at a left side of the position switching mechanism, the other end of the slide shaft is mounted on a fixing frame at a right side of the position switching mechanism; the clamp assembly is slidably mounted on the slide shaft; the motor is connected to the synchronous belt to drive the synchronous belt to move; the synchronous belt is connected to the clamp assembly to drive the clamp assembly to slide along the slide shaft; and the clamp assembly is configured to clamp the sheet-type medium stack at the bundling position and convey the sheet-type medium stack to the bundling mechanism.

2. The sheet-type medium bundling device according to claim 1, wherein the power shaft is provided with a mounting shaft sleeve, on which the stacking plates are fixedly mounted, wherein each stacking plate is of a "U" shape or a "V" shape and is opened outwards, and comprises a guiding surface located upstream of the power shaft and a stacking surface located downstream of the power shaft, an end of the guiding surface being bent towards an upstream direction of the power shaft, such that a guiding surface at the stacking position is contiguous with the end of the conveying passage.

3. The sheet-type medium bundling device according to claim 1, wherein a code disc is mounted at an end of the power shaft, the code disc being provided thereon with notches corresponding to the stacking plates, and a sensor for sensing information of the notches is mounted at a position corresponding to the code disc.

4. The sheet-type medium bundling device according to claim 1, wherein the number of the stacking plates is six, and the stacking position and the bundling position correspond to two adjacent stacking plates, respectively.

5. The sheet-type medium bundling device according to claim 1, wherein a falling position is formed downstream of the bundling position, and a falling plate is obliquely mounted at a position corresponding to the falling position.

6. The sheet-type medium bundling device according to claim 5, wherein each stacking plate is provided with a groove; and one end of the falling plate extends towards a direction of the groove to form a blocking arm, the blocking arm blocking the sheet-type medium stack on the stacking plate such that the sheet-type medium stack falls onto the falling plate, the other end of the falling plate corresponds to a position of a container for storing a sheet-type medium stack, to guide the sheet-type medium stack to fall into the container.

7. The sheet-type medium bundling device according to claim 1, wherein a sensor is mounted on the mounting frame for detecting an initial position of the clamp assembly.

8. The sheet-type medium bundling device according to claim 1, wherein the clamp assembly comprises: a sliding block slidably mounted on the slide shaft and fixedly connected to the synchronous belt; a clamping frame fixedly connected to the sliding block; an upper clamping plate and a lower clamping plate, each of the upper clamping plate and a lower clamping plate being elastically connected to the clamping frame and can rotate about a rotary shaft; and a guiding plate, one end of the guiding plate being fixedly mounted on the mounting frame, and the other end of the guiding plate being formed with a guiding head having a guiding inclined surface, wherein two limiting sliding blocks are correspondingly mounted on the opposite surfaces of the upper clamping plate and the lower clamping plate, and the guiding plate guides the upper clamping plate and the lower clamping plate to open via the guiding head and the guiding plate is supported in an angle formed by the two limiting sliding blocks.

9. The sheet-type medium bundling device according to claim 8, wherein each stacking plate is provided with a groove, and the ends of the upper clamping plate and the lower clamping plate are bent towards directions of the grooves to form an upper clamping block and a lower clamping block opposite to each other.

10. The sheet-type medium bundling device according to claim 8, wherein a supporting plate is provided perpendicularly between the upper clamping plate and the lower clamping plate, the supporting plate being elastically mounted on the upper clamping plate and can rotate about a rotary shaft; and a blocking plate is mounted at a position corresponding to the supporting plate, the blocking plate being elastically mounted on the frame and can rotate about a rotary shaft, wherein when the clamp assembly is moved along the slide shaft, the supporting plate collides with the blocking plate, and the supporting plate is rotated and is disengaged from the lower clamping plate.

11. The sheet-type medium bundling device according to claim 8, wherein the two limiting sliding blocks form a guiding angle cooperating with the guiding head.

* * * * *